United States Patent [19]

Sklaar

[11] 4,011,698

[45] Mar. 15, 1977

[54] CONSTRUCTION APPARATUS AND METHOD

[76] Inventor: Richard L. Sklaar, 320 S. Clark Drive, Los Angeles, Calif. 90048

[22] Filed: Sept. 8, 1975

[21] Appl. No.: 611,470

Related U.S. Application Data

[63] Continuation of Ser. No. 450,011, March 11, 1974, abandoned.

[52] U.S. Cl. ..... 52/98; 52/282; 52/494

[51] Int. Cl.[2] ..... E04B 5/52

[58] Field of Search ..... 52/282, 494, 98, 99, 52/100, 498, 497, 475; 248/DIG. 9

[56] References Cited

UNITED STATES PATENTS

| | | | |
|---|---|---|---|
| 3,122,223 | 2/1964 | Chek et al. | 52/475 X |
| 3,226,781 | 1/1966 | Schwabel | 52/98 X |
| 3,481,572 | 12/1969 | Casebolt et al. | 52/100 X |
| 3,487,601 | 1/1970 | James | 52/282 X |
| 3,566,561 | 10/1968 | Tozer | 52/282 X |
| 3,762,109 | 10/1973 | Cohen | 52/11 |

*Primary Examiner*—Price C. Faw, Jr.
*Assistant Examiner*—Carl D. Friedman
*Attorney, Agent, or Firm*—Nilsson, Robbins, Dalgarn & Berliner

[57] ABSTRACT

An outdoor shelter particularly of the type normally utilized in transit systems constructed of extruded aluminum members. The extruded members include outwardly extending fins each of which is scored along its base line to permit portions thereof to be easily removed for assembly purposes. Side walls are assembled by abutting the same against the fins and then utilizing a securing member which is affixed to the body of the extrusion to retain the side wall securely in place and permit side walls of varying thicknesses to be utilized without the necessity of different extrusions therefor. A roofing member is secured in place in a similar manner along with an extruded fascia, the mitered corners of which are rapidly secured together by a simple stamping.

2 Claims, 9 Drawing Figures

FIG.1.
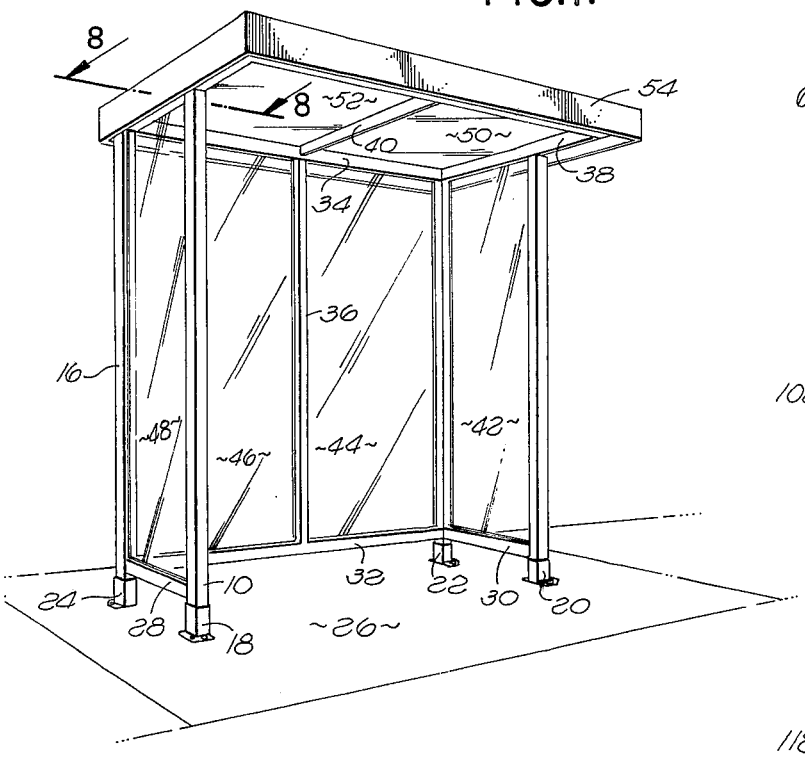
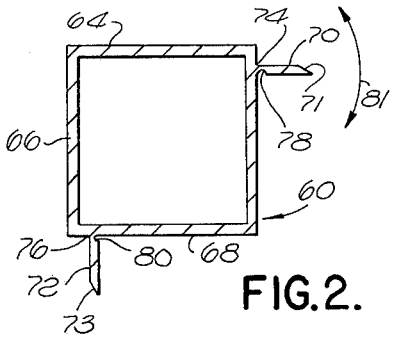
FIG.2.
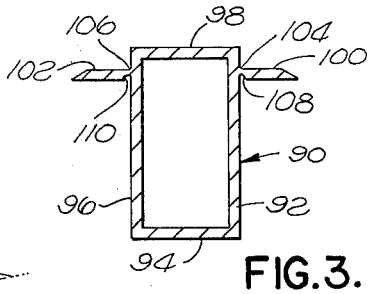
FIG.3.
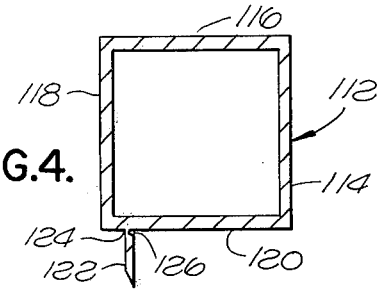
FIG.4.
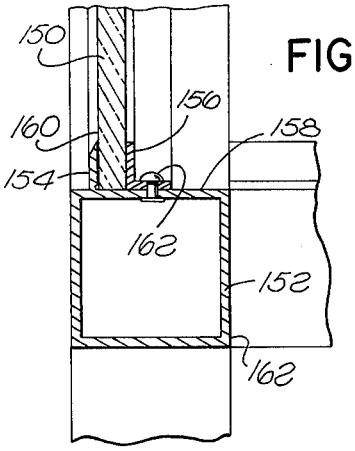
FIG.6.
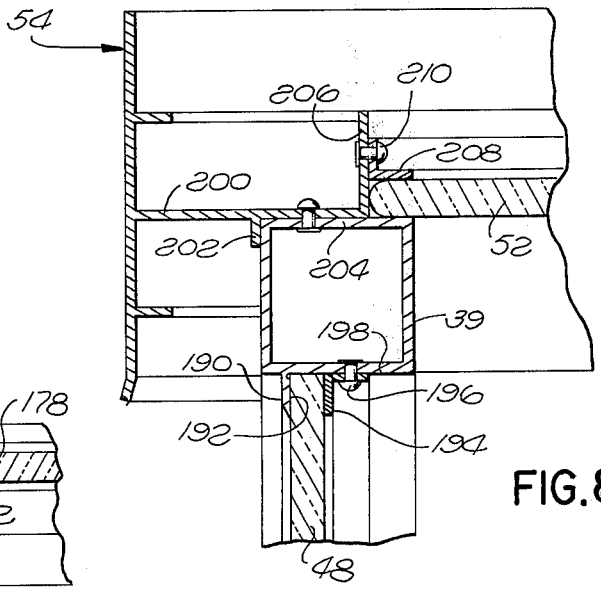
FIG.8.
FIG.7.
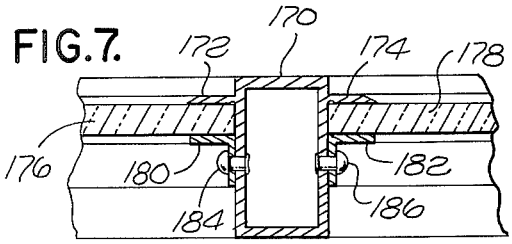

CONSTRUCTION APPARATUS AND METHOD

This is a continuation of abandoned application Ser. No. 450,011, filed Mar. 11, 1974.

BACKGROUND OF THE INVENTION

In the prior art, it has been customary for some time to utilize extruded aluminum tubing for construction purposes. The extruded aluminum forms the corner posts and horizontal bracing and support members utilized in various shelters. To support side walls between the various vertical and horizontal members, a special extrusion has been required which extrusion is riveted or otherwise secured to the tubular extrusion. Through the utilization of the special extrusion to receive the side walls of the unit, wasted material results and in addition, a special extrusion for each thickness of side wall is required. Such obviously results in added expense for tooling, inventory, handling and the like. In addition thereto, the typical fascia member utilized in the prior art is secured together at the mitered corners through the utilization of an angle bracket received in a specially extruded groove of each of the fascia members where they abut. The angle bracket is secured internally of each of the grooves. Such structure results in awkwardness during assembly as well as ill-fitting corners.

SUMMARY OF THE INVENTION

An extruded construction member having an outwardly extending fin of reduced thickness at the base thereof.

In accordance with a more specific feature, a side wall or glazing as well as the roofing of a structure abuts the outwardly extending fin and is held in place thereagainst by a securing member attached to said extruded member at a point displaced from said outwardly extending fin. More particularly, varying thicknesses of side wall and roofing panels may be accommodated with the same extruded construction member and securing member thereby eliminating the necessity for a special frame for each panel or roof thickness.

In accordance with the method of the present invention, the steps include providing an extruded construction member having an outwardly extending fin extending substantially the entire length thereof and having a reduced thickness at the base thereof, measuring a predetermined distance along said fin, cutting said fin through its entire width including the reduced thickness portion thereof, and bending that portion of said fin adjacent said cut a distance sufficient to break said fin from said member.

BRIEF DESCRIPTION OF THE DRAWINGS

FIG. 1 is a perspective view of a shelter utilizing the construction members in accordance with the present invention;

FIGS. 2, 3 and 4 are cross-sectional views illustrating construction members in accordance with the present invention;

FIGS. 6 and 7 are cross-sectional views illustrating representative portions of the structure illustrated in FIGS. 1 and 5 with the side wall paneling in place;

FIG. 8 is a cross-sectional view of a roof section of a completed structure of the type shown in FIG. 1 taken through the mitered corner thereof.

DETAILED DESCRIPTION OF THE INVENTION

Figure 5:
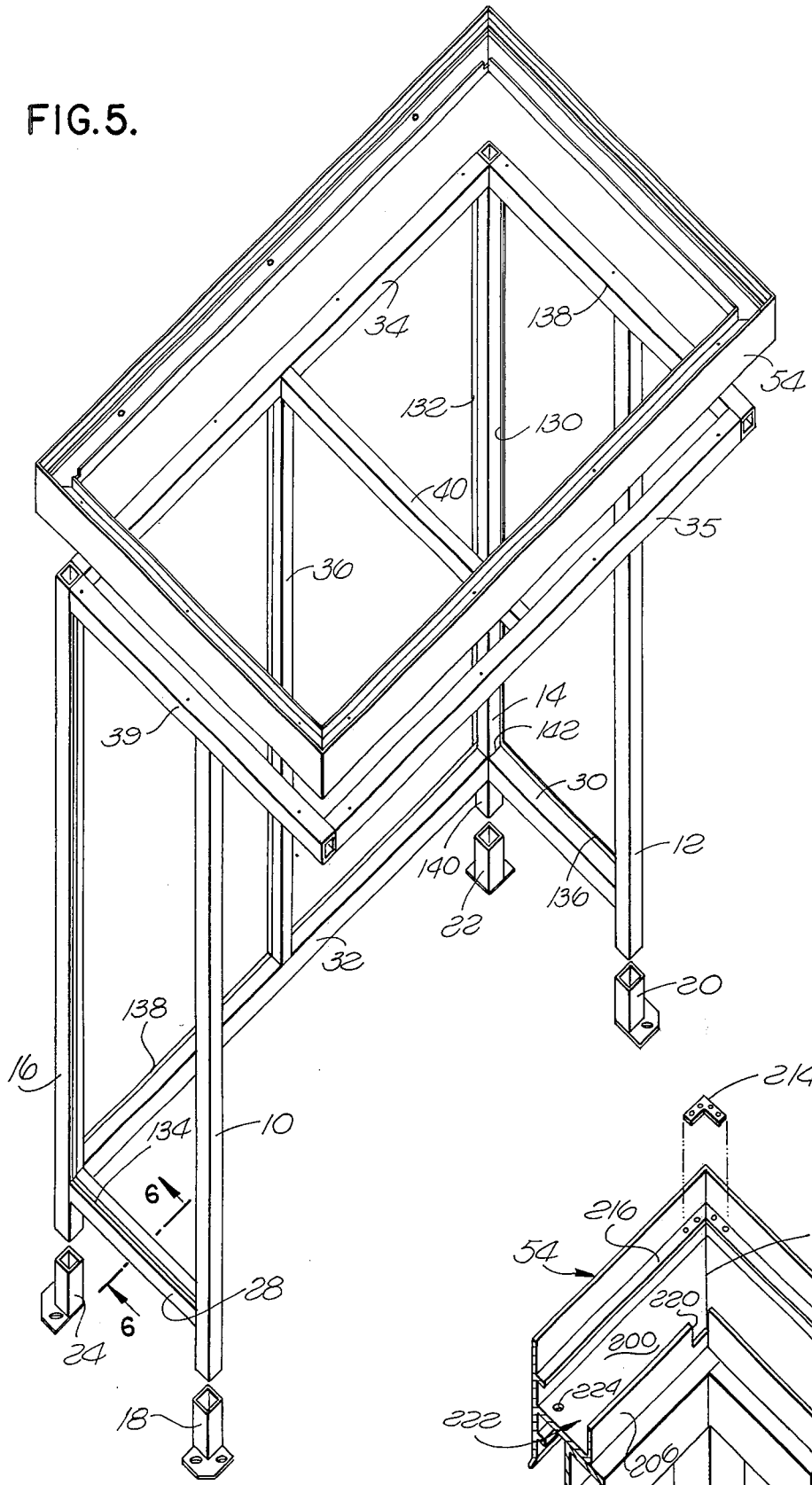
FIG. 5 is an exploded view of a structure of the type illustrated in FIG. 1 without side wall panels.

The construction members constructed in accordance with the present invention may be utilized for various types of buildings depending upon the particular application to which they are put. In addition, these members may be utilized in constructing dividers, partitions, interior walls for office space, and the like, as a particular application may require. For purposes of simplicity and ease of clarity of illustration and description, a shelter for use in mass transit systems has been chosen. Such a structure may for example be of the type illustrated in FIG. 1 of which reference is hereby made.

As is therein illustrated, front corner posts 10 and 12 and rear corner posts 14 and 16 are each secured to base members 18, 20, 22 and 24, respectively, which are fastened to an appropriate pad 26 or similar structure. A left lower horizontal member 28 extends between the vertical posts 10 and 16 while a similar member 30 extends between the posts 12 and 14. A rear horizontal member 32 extends between the rear posts 14 and 16. A rear upper horizontal member 34 also extends between the posts 14 and 16 while a vertical mullion 36 extends centrally between the lower and upper rear horizontal member 32 and 34, respectively. An upper horizontal member 38 extends from the rear post 14 over front post 12 and extends outwardly to form an overhang for the roof structure. A similar member to that shown at 38 extends from the rear post 16 over the front post 10 and also extends outwardly. However, such member is not shown in FIG. 1. A center roof support 40 also extends outwardly from the upper horizontal member 34. A member similar to that shown at 34 is also supported along the front edge of the roof structure although such is again not visible in FIG. 1. Side panels, top panels or glazing are secured in the open spaces between the vertical and horizontal members as shown at 42 through 52. These panels may be formed of any desired material and as shown in the drawing, may be constructed of a transparent polycarbonate or plexiglass, if such is desired. In addition to the foregoing, the structure as illustrated in FIG. 1 includes a fascia member 54 extending around the outer periphery of the roof structure.

Referring now to FIG. 2, there is illustrated in cross-section a construction member utilized to fabricate structures of the type shown in FIG. 1. As is shown in FIG. 2, there is provided an extrusion member having a hollow body 60 including four surfaces 62, 64, 66 and 68. Extending outwardly from the surfaces 62 and 68 are a pair of ribs or fins 70, 72, respectively. Each of the fins includes a base portion 74 and 76, respectively, which is integrally formed with the body 60 of the hollow extrusion member. The fins 70 and 72 have a reduced thickness along their entire lengths at the base 74 and 76 as is illustrated at 78 and 80, respectively. The purpose of the reduced thickness will be described in more detail hereinbelow.

A construction member as illustrated in FIG. 2 may be used in a structure such as that shown in FIG. 1 for the rear posts 14 and 16. As will be recognized, this structure is adaptable for utilization at any point where panel members extend at 90° from two surfaces of the body of the extrusion member.

Referring now to FIG. 3, there is illustrated in cross-section an additional construction member of extruded material. This construction material again includes a body member 90 having four surfaces 92, 94, 96 and 98. Extending from the surfaces 92 and 96 are outwardly extending ribs or fins 100 and 102. As before, each of the fins has a base 104 and 106, respectively, and the thickness of the fins is reduced along the entire length thereof at the base as is illustrated at 108 and 110, respectively. A member such as that shown in FIG. 3 may be utilized at any position where a panel member is extending outwardly from opposed surfaces of the extruded construction member. For example, a member such as that illustrated in FIG. 3 is adaptable for utilization as the center mullion 36 in a structure such as that shown in FIG. 1.

Referring now to FIG. 4, there is shown yet another extruded construction member in cross-section in accordance with the present invention. As is therein illustrated, there is shown a hollow body 112 having surfaces 114, 116, 118 and 120. Extending outwardly from the surface 120 is a rib or fin 122 having a base 124 which is integrally formed with the body 112. Along the entire length of the fin 122, there is a reduced thickness as illustrated at 126 which is at the base 124 thereof. A structure as illustrated in FIG. 4 may be utilized for receiving a panel member wherein such extends outwardly from only one surface of the extrusion member. Such a structure as that illustrated in FIG. 4 for example may be utilized with a structure as that shown in FIG. 1 for the corner posts 10 and 12 and for the horizontal members 32, 34, 28, 30, 40, and the member opposite 40 which cooperates with the left, front and rear posts to receive the side panel 48.

Thus, it will be recognized that by utilizing only three different extrusions, a shelter of the type shown in FIG. 1 (without the fascia) may be fully constructed. Although each of the members shown in FIGS. 2–4 is rectangular in cross-section, it will be understood that any geometric configuration desired may be employed.

Referring now to FIG. 5, the structure as illustrated in FIG. 1 is shown in a partially exploded view. The various parts in each of FIGS. 1 and 5 utilize the same reference numerals. The upper horizontal member opposed to 38 is shown at 39 in FIG. 5 and the forward horizontal member opposed to 34 is shown at 35 in FIG. 5. As will be noted from the structures illustrated in FIG. 5, the various members are constructed from hollow extrusions of the types illustrated in FIGS. 2, 3 and 4 and above described. For example, the right rear corner post 14 is shown with the outwardly extending fins 130 and 132 which corresponds to the structure shown in FIG. 2. The lower horizontal members 28, 30 and 32 each show an upwardly extending fin 134, 136 and 138, respectively, which is the type of structure as illustrated in FIG. 4. The center mullion 36 would be of the type of structure illustrated in FIG. 3 although the outwardly extending fins therefrom are not visible on both sides in FIG. 5.

The fascia structure 54 as is illustrated in FIG. 5 is seated upon the top horizontal members 34, 35, 38 and 39 and is fastened in place thereabout as by rivets, self-threading screws, or the like, as may be desired in any particular application. The fascia structure will be described in greater detail below.

It will be recognized that in assembly of structures such as that illustrated in FIG. 5, the fins 130 and 132 which extend along the rear corner post 14 necessarily would interfere with the attachment of abutting members such as the top horizontal members 34 and 38, and the side and rear horizontal members 30 and 32. However, such assembly is rendered simple, expedient and inexpensive through utilization of the extrusion members for construction and the method of assembly in accordance with the present invention. To assemble a unit such as illustrated in FIG. 5, and for example with respect to the members just referred to above, one would measure along the corner post 14 from the bottom 140 thereof up to the point where the upper edge 142 of the horizontal member 30 will extend. A similar measurement would be made with respect to the horizontal member 32. Thereafter, the fins 130 and 132 would be cut through their entire width, that is, from the outer edge thereof as shown at 71 and 73 in FIG. 2 to the base 74 and 76 respectively thereof. A worker would then bend the fins extending downwardly from the cut toward the end 140 in either direction as indicated by the arrow 81 in FIG. 2. Such bending in either direction causes the fin to shear at the base 74 and cleanly depart from the surface 62 of the body 60 of the extrusion member. When such has occurred, the horizontal member to be joined may readily and easily be affixed to the corner post 14 by any means known to the art. A similar operation will occur at each of the positions where such is required throughout the entire structure. When assembly has then been concluded an inwardly directed fin for receiving the panel member thereagainst extends around the entire inner periphery of the opening defined by horizontal and vertical members of the structure, for example as illustrated in FIG. 5.

The final assembly of the panel members with the structural members will be better understood by reference to FIGS. 6 and 7. The illustration in FIG. 6 may be a cross-section taken for example along the lines 6—6 of FIG. 5, assuming the panel 150 were in place in FIG. 5. Likewise, the FIG. 6 may be taken along any of the upper or lower horizontal members or along the vertical members 10 and 12 as may be desired. As is illustrated in FIG. 6, an extrusion member 152 of the type shown in FIG. 4 having a fin 154 formed integrally therewith and further has positioned thereon a side panel member such as a clear plastic glazing material 150. The panel 150 which may have any thickness desired for the particular application is placed in position so that it abuts the inner surface of the fin 154. Thereafter, a securing member such as an angle clip 156 is pressed into place along the surface 158 of the extrusion member 152 so that the clip 156 firmly seats against the panel 150 causing the rear surface 160 of the panel to firmly abut the outwardly extending fin 154. Thereafter, the fastening device such as a rivet 162 is used to fasten the angle clip 156 firmly in place, thus permanently securing the panel 150 into the structure. As will be readily recognized through utilization of the clip 156, any thickness of panel may be accommodated by merely positioning the clip on the extrusion at the proper position to seat against the surface of the panel member. The clip 156 may be any length desired but in most embodiments will extend along the entire length of the extrusion member 152 commensurate with the panel member.

By reference now to FIG. 7, a cross-section is illustrated taken for example along the center mullion 36 of the structure as shown in FIG. 5. As is therein illustrated, a member of the type shown in FIG. 3 is utilized and includes a body 170 having outwardly extending fins 172 and 174 formed integrally with the body 170. The plastic panels 176 and 178 are positioned so that they abut the inner surfaces of the fins 172 and 174 and thereafter are held in place by properly positioning the angle clips 180 and 182 as above described, and then fastening the same in place with the rivets 184 and 186 or such other fasteners as may be desired, such for example as self-threading screws.

It will now be recognized by those skilled in the art that a similar structure to that shown in FIG. 6 may exist with respect to the surface 162 if a corner post such as 16 in FIG. 5 were being utilized, that is, an extrusion construction member of the type shown in FIG. 2.

By referring now to FIG. 8, there is illustrated a cross-section of the fascia 54 taken about the lines 8—8 of FIG. 1. As is shown, the upper horizontal member 39 has an appropriate fin 190 extending downwardly therefrom. A side panel 48 is seated against the inner surface 192 of the fin 190. An angle clip 194 is seated against the inner surface of the panel 48 and securely holds the same in place as a result of securing the clip 194 to the wall 198 of the member 39 by means of the rivet 196. The fascia body 43 includes a center web 200 having a downwardly depending flange 202. The flange 202 locates the web 200 on the top portion 204 of the extrusion member 39. An upwardly extending flange 206 from the web 200 is utilized to define an open area on the wall 204 to receive the roofing panel member 52 which may be a translucent plastic or the like. Once the roofing member 52 is seated in place upon the side wall 204 of the member 39 an angle clip 208 is positioned along the upper surface thereof and abutting the upwardly extending flange 206 to thereby secure the roofing member 52 in place. Once properly seated, a rivet or other fastener 210 is used to secure the angle clip 208 in place. As above pointed out, the structure described allows a roofing member to be of any thickness desired for the particular application without the necessity of a special construction member or fascia being provided.

Figure 9:
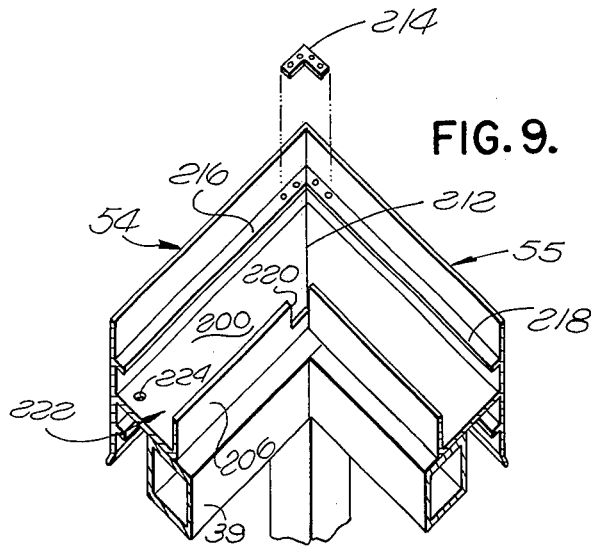
FIG. 9 is a perspective view partly in cross-section of a portion of a structure without paneling in place and further illustrating the corner construction thereof.

As is more clearly shown in FIG. 9, the fascia assembly consists of four distinct members, two of which are shown at 54 and 55. These members are brought together at a miter joint 212 and are fastened in place with 90° strap member 214 which may be constructed from a stamping or the like. The strap 214 is seated in place along the inwardly directed ribs 216 and 218 on the fascia bodies 54 and 55. Once seated, openings are provided in the strap and in the ribs, and rivets or other fasteners are utilized to secure the strap to the ribs thereby permanently securing the fascia assemblies 54 and 55 together.

For drainage purposes, there may be provided an appropriate cutout 220 at spaced intervals along the flange 206. Thus, rain or melting snow or ice will be permitted to drain into the gutter-like area 222 and from there can fall through spaced openings as shown at 224.

As will now be recognized, any of the outwardly extending fins formed with the extruded construction members may be cut and removed as desired for assembly or other purposes. Such is allowed by the reduced thickness at the base of the fins or ribs as above described. By properly cutting through the rib or fin and then bending the same, the desired portion is surprisingly easily removed and leaves little residue thus allowing immediate assembly without necessity of dressing or other cleaning operations.

Furthermore, through use of the ribs and the angle clips, there is provided a simple and expedient method of adjustment to thereby accommodate roof or side panel members of varying thicknesses or material. For example, side panels having different thicknesses may be used in the same structure by employing the construction members and method of the present invention.

What is claimed is:

1. A structure comprising:

a plurality of elongated construction members each including a body having a longitudinal surface and an outwardly extending longitudinal rib formed integrally with said body and disposed perpendicular to said surface, said rib having sufficient structural strength to support a panel member thereagainst without failure of said rib throughout the load range normally applied to said panel;

at least one of said elongated construction members further including an additional rib extending outwardly therefrom and displaced 180° from said longitudinal rib, said additional rib being load bearing and having a reduced thickness immediately adjacent said body and having sufficient structural strength to support said panel under normal load ranges, a portion of said first surface of said panel along another edge thereof seated against said additional rib;

a panel member having one edge seated on said longitudinal surface of said body and a portion of a first surface of said panel adjacent said edge seated against said rib in bearing relationship;

right angle rigid clip means having first and second orthoganally disposed arms, said first arm bearing against said panel member and said second arm bearing against said body, said clip means seated against the opposite surface of said panel member, said clip means, prior to being secured in place, being freely movable transversely of the longitudinal axis of said construction member to any position along said longitudinal surface of said construction member for seating securely against a panel member of any desired thickness; and securing means affixing said clip means rigidly to said body, said securing means being affixed to said body and said clip means through openings provided in said body only after said panel member is seated against said rib and said clip means is seated against said panel and said construction member surface, thereby to secure said panel member in place.

2. A structure as defined in claim 1 wherein at least one of said elongated construction members further includes a body having an additional rib extending outwardly therefrom and displaced 90° from said longitudinal rib, said additional rib being load bearing and having a reduced thickness immediately adjacent said body and having sufficient structural strength to support said panel under normal load ranges.

* * * * *